US010322598B2

(12) United States Patent
Kozima

(10) Patent No.: US 10,322,598 B2
(45) Date of Patent: Jun. 18, 2019

(54) BUNDLE DISCHARGE CONTROL FOR SHEET BINDING DEVICE

(71) Applicant: CANON FINETECH NISCA INC., Saitama (JP)

(72) Inventor: Yousuke Kozima, Moriya (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 15/956,038

(22) Filed: Apr. 18, 2018

(65) Prior Publication Data

US 2018/0229531 A1 Aug. 16, 2018

Related U.S. Application Data

(63) Continuation of application No. PCT/JP2016/082660, filed on Nov. 2, 2016.

(30) Foreign Application Priority Data

Dec. 25, 2015 (JP) ..... 2015-253601

(51) Int. Cl.
*B65H 37/04* (2006.01)
*B42C 1/12* (2006.01)
(Continued)

(52) U.S. Cl.
CPC ..... *B42C 1/125* (2013.01); *B65H 31/02* (2013.01); *B65H 31/10* (2013.01); *B65H 37/04* (2013.01);
(Continued)

(58) Field of Classification Search
CPC ..... B65H 37/04; B65H 31/34; B65H 2301/51616; G03G 15/6541; B31F 5/02; B31F 2201/00; B31F 2301/43828
See application file for complete search history.

(56) References Cited

U.S. PATENT DOCUMENTS 9,321,293 B2 * 4/2016 Obuchi ..... B42C 5/00
2009/0226231 A1 9/2009 Ohkawa
(Continued)

FOREIGN PATENT DOCUMENTS

JP H04-173192 A 6/1992
JP H08-151158 A 6/1996
(Continued)

OTHER PUBLICATIONS

Search Report dated Jan. 24, 2017, in International Application No. PCT/JP2016/082660.
(Continued)

*Primary Examiner* — Patrick H Mackey
(74) *Attorney, Agent, or Firm* — Venable LLP

(57) ABSTRACT

A bundle of printing media by eco-stapling often has a smaller thickness than a bundle of printing media by needle stapling by the thickness corresponding to an amount of used staples, although they have the same number of printing media, and there is room capable of stacking bundles in many cases in the eco-stapling. According to an embodiment, when a printing medium that has undergone an image forming process is taken in, stapling processing is performed on the printing medium, and then the printing medium is discharged to the tray, the following process is performed. That is, when the process is performed in accordance with instructed stapling processing, and the printing medium that has undergone the process is discharged outside the apparatus, the amount of printing media stacked on the tray is controlled in accordance with instructed stapling processing.

6 Claims, 8 Drawing Sheets

(51) Int. Cl.

| | |
|---|---|
| ***B65H 43/06*** | (2006.01) |
| ***B65H 43/02*** | (2006.01) |
| ***G03G 15/00*** | (2006.01) |
| ***B65H 31/02*** | (2006.01) |
| ***B65H 31/10*** | (2006.01) |

(52) U.S. Cl.

CPC ..... *B65H 43/02* (2013.01); *B65H 43/06* (2013.01); *G03G 15/6544* (2013.01); *B65H 2220/01* (2013.01); *B65H 2301/1635* (2013.01); *B65H 2301/4212* (2013.01); *B65H 2301/4213* (2013.01); *B65H 2301/43828* (2013.01); *B65H 2301/51611* (2013.01); *B65H 2405/11151* (2013.01); *B65H 2408/12* (2013.01); *B65H 2511/30* (2013.01); *B65H 2511/414* (2013.01); *B65H 2513/512* (2013.01); *B65H 2551/20* (2013.01); *B65H 2601/271* (2013.01); *B65H 2701/1829* (2013.01); *B65H 2701/18292* (2013.01); *B65H 2801/06* (2013.01); *B65H 2801/27* (2013.01); *G03G 2215/00827* (2013.01)

(56) References Cited

U.S. PATENT DOCUMENTS

| | | | | |
|---|---|---|---|---|
| 2014/0015188 | A1* | 1/2014 | Tokuma | B65H 37/04 270/58.12 |
| 2014/0161565 | A1* | 6/2014 | Obuchi | B42C 5/00 412/33 |
| 2015/0353316 | A1* | 12/2015 | Abe | B65H 37/04 270/58.08 |
| 2017/0183190 | A1* | 6/2017 | Matsuki | B65H 33/08 |

FOREIGN PATENT DOCUMENTS

| | | | |
|---|---|---|---|
| JP | 2001-322765 | A | 11/2001 |
| JP | 2006-089200 | A | 4/2006 |
| JP | 2007-070011 | A | 3/2007 |
| JP | 2014-177319 | A | 9/2014 |
| JP | 2015-089845 | A | 5/2015 |
| JP | 2015-117084 | A | 6/2015 |

OTHER PUBLICATIONS

Search Report dated Dec. 17, 2018, in European Patent Application No. 16878157.3.

* cited by examiner

BUNDLE DISCHARGE CONTROL FOR SHEET BINDING DEVICE

CROSS-REFERENCE TO RELATED APPLICATIONS

This application is a Continuation of International Patent Application No. PCT/JP2016/082660, filed Nov. 2, 2016, which claims the benefit of Japanese Patent Application No. 2015-253601, filed Dec. 25, 2015, both of which are hereby incorporated by reference herein in their entirety.

BACKGROUND OF THE INVENTION

Field of the Invention

The present invention relates to a sheet binding processing apparatus, an image forming system, and a sheet binding processing method and, more particularly, to, for example, a method of stacking sheets that have undergone binding processing.

Background Art

There is a case in which a sheet processing apparatus for performing various types of post-processing on a sheet-like printing medium on which an image has been formed by an image forming apparatus is provided in a conventional image forming system. As such a sheet processing apparatus, there is known, for example, a sheet binding processing apparatus (to be referred to as a needle stapler hereinafter) with a stapler that binds a bundle made of a plurality of printing media by using binding members such as metal staples. Binding processing by the needle stapler will be referred to as needle stapling processing hereinafter.

The sheet binding processing apparatus performs the above-described sheet binding processing and discharges/stacks printing media to/on a predetermined tray. It is necessary to set the height of the printing media stacked on that tray to a height that does not inhibit discharge of the printing media. For this reason, an operation is suspended when the number of printing media stacked on that tray reaches a predetermined number. In such a sheet binding processing apparatus, a bundle of printing media that has undergone needle stapling processing becomes higher by portions of staples. If such a bundle is stacked on the tray, a sheet height cannot be determined correctly, the bundle may block a printing medium discharge port, and discharge of the printing media may be left undone. Moreover, the bundle unpiles as the portions of the staples become thicker, making it impossible to align and stack the bundle.

In order to solve such problems, patent literature 1 proposes control capable of suspending an operation not only by the number of sheets but also by the number of stapled bundles. Patent literature 2 proposes an arrangement in which the number of sheets discharged to and stacked on a tray is converted into a stacking point and counted, the stacking point is counted in correspondence with a paper size or a non-binding mode/binding mode, and the total is controlled so as not to exceed the predetermined value of the tray.

CITATION LIST

Patent Literature

Patent Literature 1: Japanese Patent Laid-Open No. 4-173192

Patent Literature 2: Japanese Patent Laid-Open No. 2007-70011

Staplers that perform binding processing without using any binding member such as a staple are sold in large numbers because of recent rising awareness of ecological problems. In response to such a trend, a sheet binding processing apparatus that binds a bundle of printing media without using any binding member (to be referred to as an eco-stapler) has also been proposed as a sheet processing apparatus of an image forming system. Binding processing by the eco-stapler will be referred to as eco-stapling processing hereinafter.

FIG. 8 is a view showing the state of a bundle of printing media that has undergone needle stapling processing by a conventional sheet binding processing apparatus, and is discharged to and stacked on a tray. FIG. 9 is a view showing the state of a bundle of printing media that has undergone eco-stapling processing using a press-bonding method by the conventional sheet binding processing apparatus, and is discharged to and stacked on the tray.

Both FIGS. 8 and 9 are the views when a sheet binding processing apparatus 500 is viewed from the side of two discharge ports 700*a* and 701*a* that discharge the printing media outside the apparatus. The sheet binding processing apparatus 500 includes, in correspondence with these two discharge ports, respectively, trays 700 and 701 that stack the discharged printing media.

As seen by comparing FIG. 8 with FIG. 9, the bundle of printing media bound by eco-stapling processing (FIG. 9) is different from the bundle of printing media bound by needle stapling processing (FIG. 8) by the thickness corresponding to the amount of used staples. In the case of the bundle bound by eco-stapling processing using the press-bonding method as shown in FIG. 9, in particular, unevenness in height of the bundle is small. Therefore, if a discharge operation is suspended with the same upper limit number as needle stapling processing, the tray still has room capable of stacking another bundle in many cases.

As described above, in the conventional sheet binding processing apparatus, the discharge operation may be suspended in spite of the fact that there is still room for stacking, keeping a user waiting more than necessary.

The present invention has been made in consideration of the above-described related art, and has as its objective to provide a sheet binding processing apparatus, image forming system, and sheet binding processing method capable of setting the volume of sheets stacked on a stacking unit to an appropriate volume according to the type of binding processing.

SUMMARY OF THE INVENTION

In order to achieve the above-described objective, a sheet binding processing apparatus of the present invention has a following configuration.

That is, there is provided a sheet binding processing apparatus comprising: a sheet binding unit configured to be capable of performing a plurality of sheet binding processing; and a control unit configured to change, in accordance with sheet binding processing executed by the sheet binding unit, a stackable amount of sheets, that have undergone sheet binding processing, on a stacking unit.

According to another aspect of the present invention, there is provided an image forming system comprising: a sheet binding processing apparatus having the above construction; and an image forming apparatus that forms an image on a sheet and outputs the sheet on which the image has been formed to the sheet binding processing apparatus.

According to still another aspect of the present invention, there is provided a sheet binding processing method comprising: performing a plurality of sheet binding processing; and changing, in accordance with sheet binding processing performed in the performing, a stackable amount of sheets, that have undergone sheet binding processing, on a stacking unit.

Further features of the present invention will become apparent from the following description of exemplary embodiments with reference to the attached drawings.

BRIEF DESCRIPTION OF THE DRAWINGS

The accompanying drawings are included in this specification and are used to form a part thereof, show embodiments of the present invention, and describe the principle of the present invention together with its description.

DESCRIPTION OF THE EMBODIMENTS

In this specification, the term "printing" (to be also referred to as "print") not only includes the formation of significant information such as characters and graphics, but also broadly includes the formation of images, figures, patterns, and the like on a printing medium, or the processing of the medium, regardless of whether they are significant or insignificant and whether they are so visualized as to be visually perceivable by humans.

Also, the term "printing medium" not only includes paper used in common printing apparatuses, but also broadly includes materials, such as cloth, a plastic film, a metal plate, glass, ceramics, wood, and leather, capable of accepting ink.

In embodiments below, a description will be given by taking an image forming unit of a copying machine equipped with an image reading unit (scanner) as an example of an image forming apparatus. However, the present invention is not limited to this. For example, an image forming apparatus (printing apparatus) independent as a single function apparatus or a multi-function peripheral obtained by adding a facsimile function to the copying machine may be used as the above-described image forming unit. Further, an apparatus of an arrangement that includes not only a printer engine according to an electrophotographic method but also a printer engine adopting an inkjet printing method may be used as the image forming unit.

An example will be described in which a sheet binding processing apparatus is externally attached to the main body of the copying machine. However, a configuration may be adopted in which the apparatus is incorporated into the main body.

<Description of Copying Machine (FIG. 1)>

Figure 1:
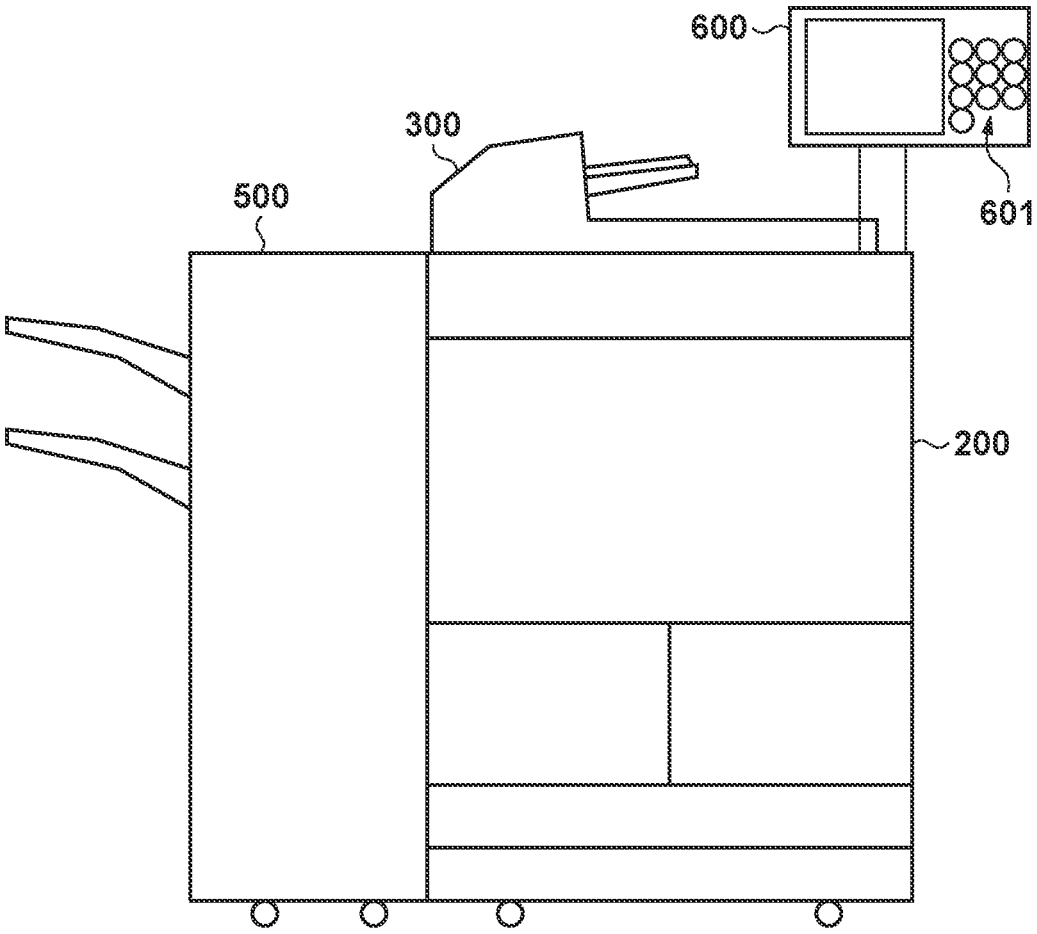
FIG. 1 is a front view showing the overview of a copying machine.

FIG. 1 is an exemplary example of the present invention, and is a front view showing the schematic arrangement of the image forming system (copying machine) that is equipped with the image reading unit (scanner) and the image forming unit (image forming apparatus) which forms an image on a printing medium such as printing paper according to the electrophotographic method and includes the sheet binding processing apparatus.

As shown in FIG. 1, the image forming system includes an image forming apparatus 200 that forms an image according to the electrophotographic method, an image reading apparatus 300, an operation unit 600 with a ten-key pad 601, and a sheet binding processing apparatus 500.

The image reading apparatus 300 includes an original feeding apparatus, conveys, to a reading position, a plurality of sheet-like originals placed on an original tray of the original feeding apparatus one by one, generates image data by reading an image of each original, and transfers this to the image forming apparatus 200. The image forming apparatus 200 forms an image based on the image data transferred from the image reading apparatus 300 and forms an image on a sheet-like printing medium such as printing paper. The printing medium on which the image has been formed is conveyed from the image forming apparatus 200 to the sheet binding processing apparatus 500.

The sheet binding processing apparatus 500 performs binding processing on the printing medium conveyed from the image forming apparatus 200. In this embodiment, binding processing is performed on a bundle obtained by binding a plurality of printing media. With respect to the image forming apparatus 200, the image reading apparatus 300, and the sheet binding processing apparatus 500, the operation unit 600 is an interface for a user to input an instruction to the image forming system or for informing the user of information from the image forming system. By the instruction from the user, a series of processes such as original reading, image formation, binding processing, and the like is performed. The operation unit 600 also includes a display and notifies the user of various kinds of information via the display. The operation unit 600 may be configured as, for example, a touch panel capable of performing an input instruction and display output.

The image forming apparatus 200 includes a photosensitive drum on which an electrostatic latent image is formed and a developer configured to develop the electrostatic latent image. A toner image is formed on the photosensitive drum by developing the electrostatic latent image. The electrostatic latent image is formed by a laser scanner that exposes the photosensitive drum with beam light in accordance with image data. The laser scanner can obtain image data not only from the image reading apparatus 300 but also from a host computer (to be referred to as a host hereinafter) to be described later.

Toner images formed on the photosensitive drum are sequentially transferred, by a transfer belt and a transfer roller, to printing media conveyed from a paper feed cassette. A fixing unit performs thermo-pressure bonding on the toner images, fixing images to the printing media to which the toner images have been transferred. The printing media to which the images are fixed are conveyed from the image forming apparatus 200 to the sheet binding processing apparatus 500.

Note that the arrangement of the image forming apparatus described above is merely illustrative. The present invention is not limited to the above-described arrangement as long as an arrangement is adopted in which an image is formed on a sheet-like printing medium and conveyed to the sheet binding processing apparatus 500.

The sheet binding processing apparatus 500 may be of a type incorporated in the image forming apparatus 200.

<Description of Sheet Binding Processing Apparatus (FIG. 2)>

Figure 2:
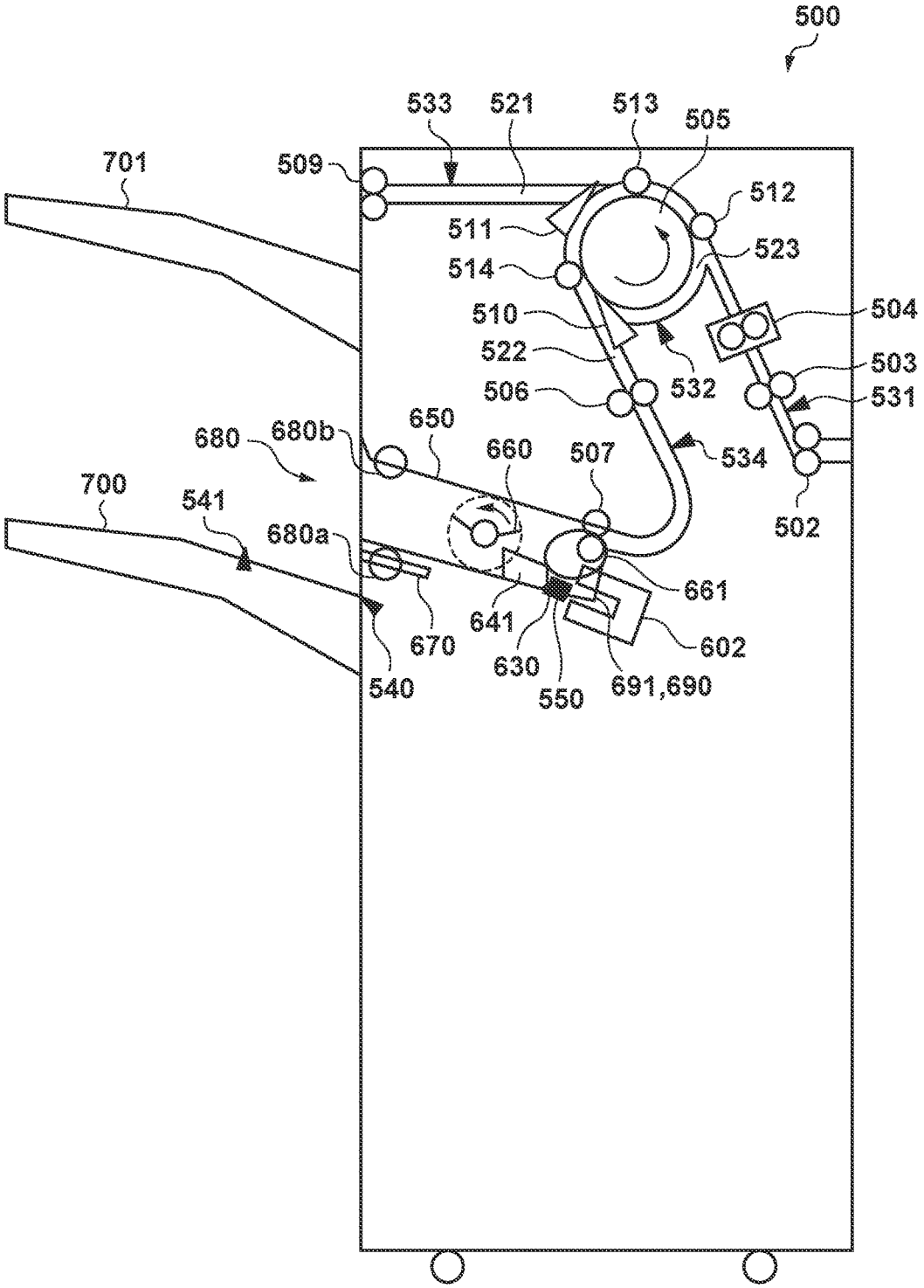
FIG. 2 is a sectional view showing the arrangement of a sheet binding processing apparatus shown in FIG. 1.

FIG. 2 is a sectional view showing the detailed arrangement of the sheet binding processing apparatus. The sheet binding processing apparatus 500 sequentially takes in the printing media conveyed from the image forming apparatus 200 and performs various kinds of sheet processing. The sheet processing includes processing for obtaining a bundle by binding a plurality of printing media, needle stapling processing for binding the bundle with a binding member (for example, a staple), eco-stapling processing for binding the bundle without using any binding member, sorting processing for aligning the printing media without binding and discharging it, non-sorting processing for discharging the printing media without aligning them, and the like.

As shown in FIG. 2, the sheet binding processing apparatus 500 includes, as the first binding processing mechanism that performs binding processing on a bundle of printing media, a needle stapler 602 that performs binding processing on the bundle of printing media by using a binding member such as a staple. The sheet binding processing apparatus 500 also includes, as the second binding processing mechanism, a staple free stapler (eco-stapler) 630 that performs binding processing on the bundle of printing media without using any binding member. Because the needle stapler uses the binding member, it has a higher binding ability and the larger number of printing media that can be bound in one binding processing operation than the eco-stapler.

The printing medium conveyed from the image forming apparatus 200 is sandwiched by an inlet roller pair 502 and further conveyed by conveyance roller pairs 503 and 504, reaching a buffer roller 505. Note that a conveyance sensor 531 that detects the printing medium is provided between the inlet roller pair 502 and the conveyance roller pair 503.

The buffer roller 505 includes press rollers 512, 513, and 514 around its circumference, and can stack and wind the predetermined number of conveyed printing media. By rotating the buffer roller 505, the press rollers 512, 513, and 514 wind the printing medium around the buffer roller 505. The buffer roller 505 rotates counterclockwise as shown in this figure, and the printing medium wound around the buffer roller 505 is conveyed in the rotation direction of the buffer roller 505.

A switching flapper 511 is provided between the press roller 513 and the press roller 514. A switching flapper 510 is provided on the downstream side of the press roller 514. By the operations of the switching flapper 511 and switching flapper 510, the printing medium wound around the buffer roller 505 is conveyed to one of a non-sorting path 521, a buffer path 523, and a sorting path 522. When the printing media are conveyed to the non-sorting path 521 and the sorting path 522, the predetermined number of printing media are stacked in the buffer roller 505, and thus the printing media are conveyed as a bundle.

When the bundle of printing media wound around the buffer roller 505 is guided to the non-sorting path 521, the switching flapper 511 operates. The switching flapper 511 moves its tip to the side of the buffer roller 505, separates the bundle of printing media wound around the buffer roller 505, and guides it to the non-sorting path 521. The bundle of printing media guided to the non-sorting path 521 is discharged, via a conveyance roller pair 509, to a tray 701 serving as a stacking unit. A conveyance sensor 533 that detects passage of the bundle of printing media is provided on the path of the non-sorting path 521.

When the bundle of printing media wound around the buffer roller 505 is guided to the buffer path 523, neither switching flapper 510 nor switching flapper 511 operates, and each of their tips is positioned apart from the buffer roller 505. The bundle of printing media is conveyed to the buffer path 523 while being wound around the buffer roller 505. A conveyance sensor 532 that detects passage of the bundle of printing media is provided on the path of the buffer path 523.

When the bundle of printing media wound around the buffer roller 505 is guided to the sorting path 522, the switching flapper 511 does not operate, and only the switching flapper 510 operates. The switching flapper 510 moves its tip to the side of the buffer roller 505, separates the bundle of printing media wound around the buffer roller 505, and guides it to the sorting path 522. The bundle of printing media guided to the sorting path 522 is conveyed to the processing tray 630 via conveyance roller pairs 506 and 507. A conveyance sensor 534 that detects passage of the bundle of printing media is provided on the path of the sorting path 522.

The bundle of printing media conveyed to the processing tray 630 undergoes eco-stapling processing or needle stapling processing. A knurling belt 661 and paddle 660 driven in synchronism with the conveyance roller pair 507 pull the bundle of printing media conveyed to the processing tray 630 back to a trailing-end side in a conveyance direction. When an eco-stapler 550 is used, the bundle of printing media is pulled back until it abuts against an eco-stapling alignment plate 690 and undergoes alignment processing in the conveyance direction. The eco-stapler 550 is an eco-stapling processing mechanism that performs binding processing, without using any binding member such as a staple, on the bundle of printing media stacked at this position.

At the time of needle stapling processing, the bundle of printing media is pulled back by the knurling belt 661 and the paddle 660 until it abuts against a staple alignment plate 691, and undergoes alignment processing in the conveyance direction. The needle stapler 602 is a needle stapling processing mechanism that performs, by using the binding member such as the staple, on the bundle of printing media stacked at this position. As described above, the stacking position (binding position) of the bundle of printing media is different between the times of eco-stapling processing and needle stapling processing. Note that the needle stapler 602 can move in a direction perpendicular to the conveyance direction along the circumference of the processing tray 630 and can perform binding processing at a position set by the user.

An alignment member 641 is provided in the processing tray 630 so as to hold the side end portions of the bundle of printing media. The alignment member 641 is configured to be movable in a direction (widthwise direction) perpendicular to the conveyance direction of the bundle of printing media and performs alignment processing on the bundle of printing media conveyed onto the processing tray 630 in the widthwise direction (direction perpendicular to drawing paper). Thus, the sheet binding processing apparatus 500 can provide, by performing alignment processing in the conveyance direction and the widthwise direction each time the printing media are stacked on the processing tray 630, a bundle of printing media with less misalignment even if it performs binding processing on the large number of printing media.

The bundle of printing media that has undergone alignment processing and binding processing is discharged to a tray 700 by a discharge roller pair 680 formed by discharge rollers 680*a* and 680*b*. A swing guide 650 supports the discharge roller 680*b*. The swing guide 650 swings so as to bring the discharge roller 680*b* in contact with the uppermost portion of the bundle of printing media stacked on the processing tray 630. When the discharge roller 680*b* is in contact with the uppermost portion of the bundle of printing media stacked on the processing tray 630, the discharge roller pair 680 can discharge the bundle of printing media stacked on the processing tray 630 toward the tray 700 via a discharge port. Therefore, the tray 700 is also referred to as a discharge tray.

A tray 670 protrudes upward when the bundle of printing media is stacked on the processing tray 630. This prevents the bundle of printing media conveyed by the conveyance roller pair 507 from sagging or being unable to return to straight, aligning the bundle of printing media on the processing tray 630.

The tray 700 can lift and moves downward as the number of bundles of printing media discharged from the discharge port increases, preventing the discharge port from being blocked by the bundles of discharged printing media. Therefore, a paper surface detection sensor 540 detects the tray 700 or the uppermost surface of the bundle of printing media on the tray 700. In accordance with a detection result by the paper surface detection sensor 540, the tray 700 is controlled to lift such that the uppermost surface of the bundle of printing media has a predetermined position. If the tray 700 cannot move downward anymore, discharge of the printing media is stopped regardless of the presence/absence of binding processing in order to prevent the discharge port from being blocked by the bundle of discharged printing media. A paper presence detection sensor 541 detects the presence/absence of the printing medium on the tray 700. When the user takes out the bundle of printing media, the tray 700 moves upward and is adjusted such that a distance between the tray 700 and the discharge port becomes constant. Note that the tray 701 cannot lift as the tray 700 and is fixed at a position shown in FIG. 2.

<Description of Control Arrangement (FIG. 3)>

Figure 3:
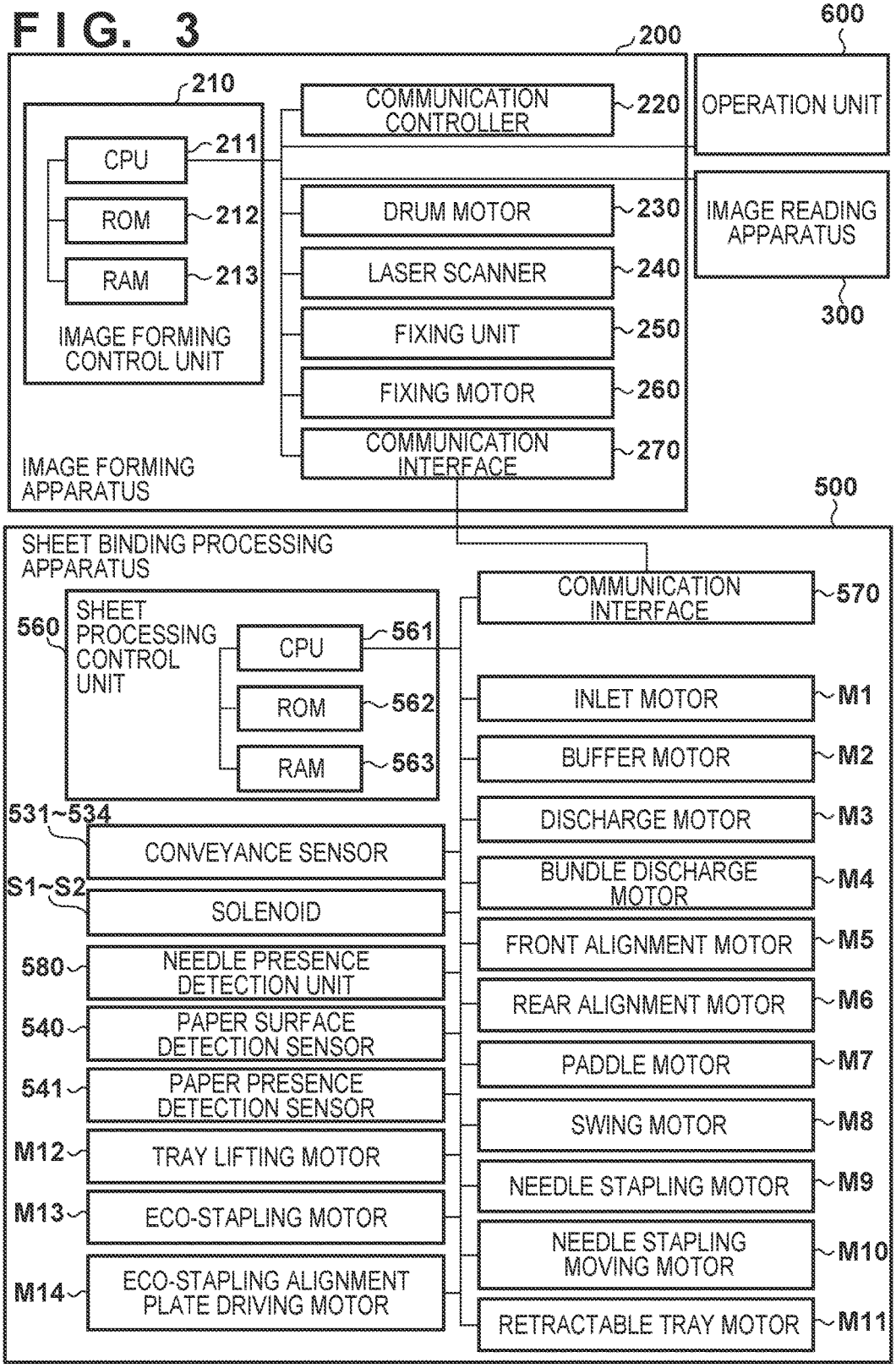
FIG. 3 is a block diagram showing the control arrangement of the copying machine shown in FIG. 1.

FIG. 3 is a block diagram schematically showing a control arrangement for controlling driving of the copying machine.

An image forming control unit 210 mainly controls the image forming apparatus 200, the image reading apparatus 300, and the operation unit 600. The image forming control unit 210 includes a CPU 211, a ROM 212, and a RAM 213. The CPU 211 uses the RAM 213 as a work area, and controls the image forming apparatus 200, the image reading apparatus 300, and the operation unit 600 by reading and executing control programs from the ROM 212 as needed.

A communication controller 220 receives an instruction for image formation or the like from a host computer (to be referred to as a host hereinafter). The host is, for example, a personal computer connected in order to transmit/receive data to/from the image forming system via a network such as a LAN. The communication controller 220 sends the received instruction to the image forming control unit 210. Based on the instruction sent from the communication controller 220, the CPU 211 controls the operations of a drum motor 230, laser scanner 240, fixing unit 250, and fixing motor 260 in the image forming apparatus 200. Consequently, an image is formed on a sheet-like printing medium (for example, cut paper). Note that such an instruction can also be input from the operation unit 600 to the image forming control unit 210 directly, in addition to the host. The CPU 211 can transmit/receive data to/from the sheet binding processing apparatus 500 via a communication interface 270.

A sheet binding processing control unit 560 mainly controls the sheet binding processing apparatus 500. The sheet binding processing control unit 560 includes a CPU 561, a ROM 562, and a RAM 563. Based on data received from the image forming apparatus 200 via a communication interface 570, the CPU 561 uses the RAM 563 as a work area, and controls the sheet binding processing apparatus 500 by reading and executing control programs from the ROM 562 as needed.

In order to convey the sheet-like printing medium, the sheet binding processing apparatus 500 includes an inlet motor M1, a buffer motor M2, a discharge motor M3, solenoids S1 and S2, and the conveyance sensors 531 to 534. The inlet motor M1 drives the inlet roller pair 502, and the conveyance roller pairs 503 and 504. The buffer motor M2 drives the buffer roller 505. The discharge motor M3 drives the conveyance roller pairs 507 and 509. The solenoid S1 drives the switching flapper 511. The solenoid S2 drives the switching flapper 510.

The sheet binding processing apparatus 500 also includes a bundle discharge motor M4, a swing motor M8, a retractable tray motor M11, a tray lifting motor M12, the paper surface detection sensor 540, and the paper presence detection sensor 541 for performing processing such as sorting processing on the printing media. The bundle discharge motor M4 drives the discharge roller pair 680. The swing motor M8 drives the swing guide 650. The retractable tray motor M11 drives the tray 670 to retract it outside the apparatus. The tray lifting motor M12 lifts up and moves down the tray 700.

In order to perform binding processing, the sheet binding processing apparatus 500 also includes a front alignment motor M5, a rear alignment motor M6, a paddle motor M7, a needle stapling motor M9, a needle stapling moving motor M10, an eco-stapling motor M13, and an eco-stapling alignment plate driving motor M14. The front alignment motor M5 and the rear alignment motor M6 drive the alignment member 641. The paddle motor M7 drives the paddle 660. The needle stapling motor M9 drives the needle stapler 602. The needle stapling moving motor M10 moves the needle stapler 602.

As described with reference to FIG. 2, the eco-stapling motor M13 drives the eco-stapler 550. The eco-stapling alignment plate driving motor M14 lifts up and moves down the eco-stapling alignment plate 690. The sheet binding processing apparatus 500 further includes a needle presence detection unit 580 and detects the presence/absence of the needle stapler 602 by using this.

The sheet binding processing apparatus 500 receives, from the image forming apparatus 200, an instruction for sheet processing performed by the host or the operation unit 600 via the communication interface 570. The sheet processing control unit 560 performs sheet processing based on the received instruction.

In this embodiment, an example will specifically be described in which binding processing is instructed as sheet processing. In accordance with the instruction for binding processing, the sheet processing control unit 560 controls the respective units of the apparatus such as the needle stapling motor M9, the needle stapling moving motor M10, the eco-stapling motor M13, and the like used for binding processing.

The user can select, by the operation unit 600, one of needle stapling processing, eco-stapling processing, and automatic stapling processing as binding processing. In "automatic stapling processing", the image forming system determines, in accordance with the number of printing media of a bundle, whether to perform binding processing by one of eco-stapling processing and needle stapling processing.

Figure 4:
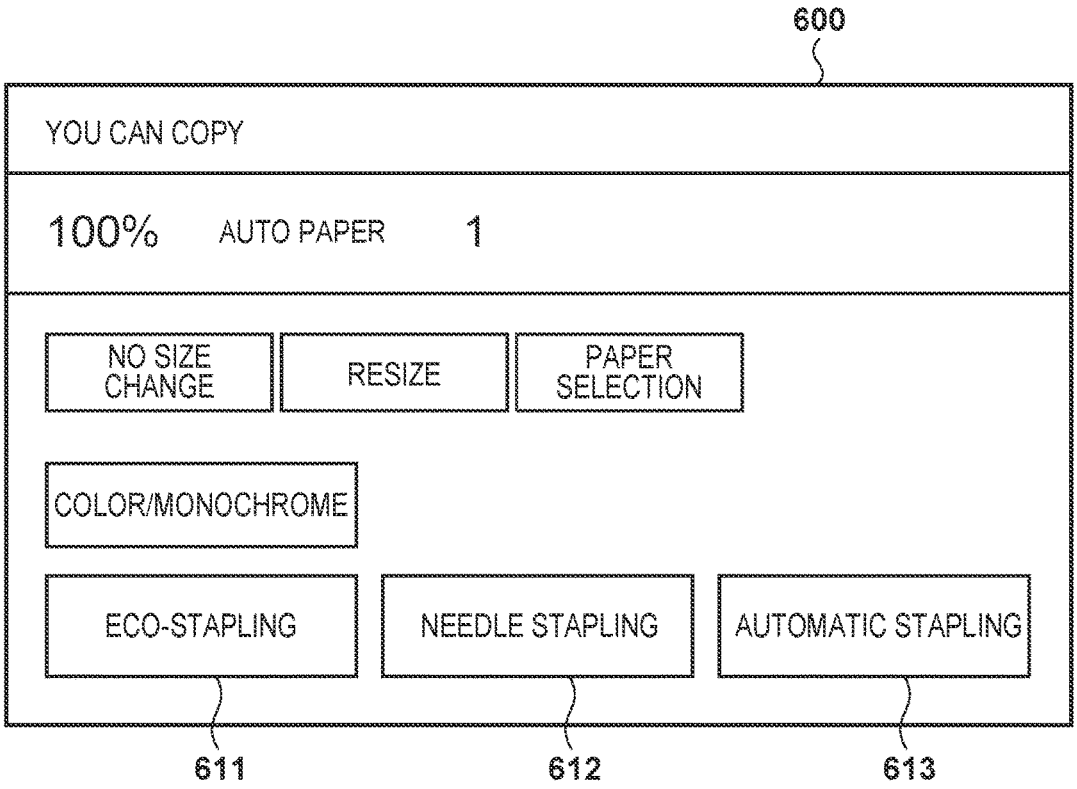
FIG. 4 is a view showing an example of a display screen of an operation panel of the copying machine shown in FIG. 1.

FIG. 4 is a view showing an example of a display screen on which such selection of the processing mode of binding processing (to be referred to as a binding processing mode hereinafter) is made. This selection screen is displayed on the display of the operation unit 600. Selection icons of eco-stapling 611, needle stapling 612, and automatic stapling 613 are displayed on this selection screen, and the user can select one of these.

The user selects, from the displayed selection screen, the binding processing mode by a touch operation on the display or the operation of the ten-key pad 601. The sheet binding processing apparatus 500 receives that selection result via the image forming apparatus 200. The sheet binding processing apparatus 500 performs binding processing by the needle stapler 602 if the selection result gives an instruction to perform needle stapling processing or performs binding processing by the eco-stapler 550 if the result gives an instruction to perform eco-stapling processing. Alternatively, if the selection result gives an instruction to perform automatic stapling processing, the sheet binding processing apparatus 500 performs binding processing by the eco-stapler 550 or the needle stapler 602 in accordance with the number of printing media of a bundle.

Note that when the needle stapler 602 and a constituent element related to it are used as binding processing, constituent elements related to that binding processing will collectively be referred to as the first binding processing mechanism. On the other hand, when the eco-stapler 550 and a constituent element related to it are used as binding processing, constituent elements related to that binding processing will collectively be referred to as the second binding processing mechanism.

Two embodiments of binding processing executed by the copying machine of the above-described arrangement will now be described with reference to flowcharts.

First Embodiment

Figure 5:
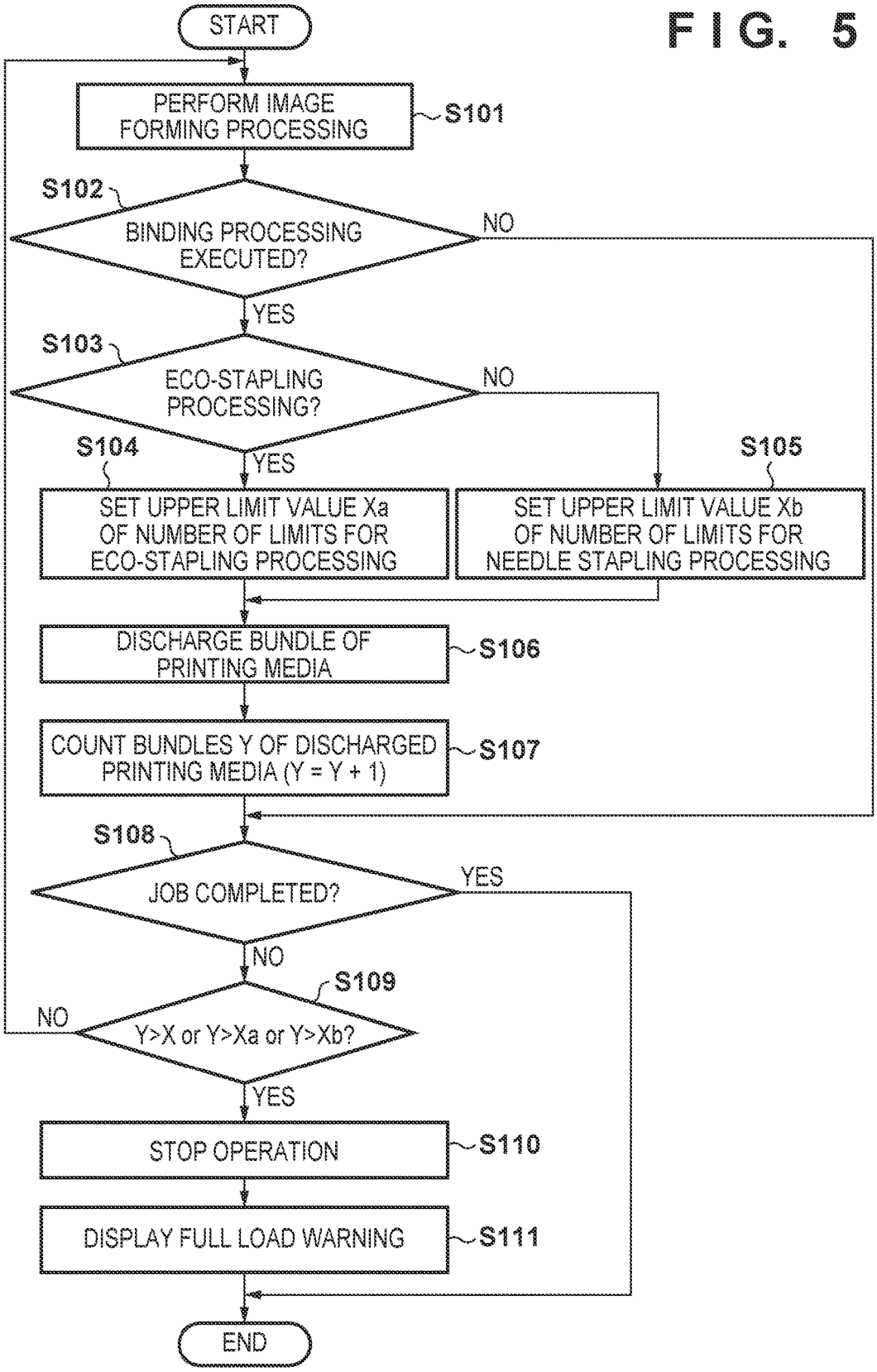
FIG. 5 is a flowchart showing binding processing according to the first embodiment.

FIG. 5 is a flowchart showing binding processing according to the first embodiment.

First, an image forming apparatus 200 forms images in accordance with various print instructions of an input print job in step S101, and printing media on which the images have been formed are conveyed to a sheet binding processing apparatus 500. Then, in step S102, it is determined whether binding processing is executed, as sheet processing, on the printing media conveyed to the sheet binding processing apparatus 500. If it is determined that binding processing is not executed, the printing media are counted, and the process advances to processing step S108. In contrast, if it is determined that binding processing is executed, the process advances to step S103.

In step S103, it is determined whether the processing is needle stapling processing by a needle stapler 602 or eco-stapling processing by an eco-stapler 550. If it is determined here that eco-stapling processing is performed (if the second binding processing mechanism is used), the process advances to step S104 in which an upper limit value Xa of the number of stacked copies for eco-stapling processing is set. In contrast, if it is determined that needle stapling processing is performed (if the first binding processing mechanism is used), the process advances to step S105 in which an upper limit value Xb of the number of stacked copies for needle stapling processing is set. Binding processing is executed after the setting in step S104 or step S105, and then a bundle of printing media is discharged to and stacked on a tray 700 in step S106. Then, in step S107, bundles Y of printing media discharged to the tray 700 are counted.

After that, it is determined in step S108 whether the input print job is completed. If it is determined here that the print job is completed, the process ends. However, if it is determined that the print job is not completed, the process advances to step S109.

In step S109, a set upper limit value X of the number of stacked copies, or the upper limit value Xa or Xb of the number of stacked copies is compared with the count value Y of the number of bundles of printing media discharged to the tray 700. Note that the upper limit value X of the number of stacked copies is a value set when the sheet binding processing apparatus does not execute binding processing, and this value is set as a default value when the sheet binding processing apparatus 500 is activated.

If it is determined here that the count value Y of the number of bundles of printing media exceeds the upper limit value of the number of stacked copies (X, Xa, or Xb) ($Y>X$, $Y>Xa$, or $Y>Xb$), the process advances to step S110 in which a discharge operation is stopped. Further, in step S111, the sheet binding processing apparatus 500 notifies the image forming apparatus 200 of the full load state of the tray 700 and displays a warning message on the display of an operation unit 600. Subsequently, the process ends.

Figure 6:
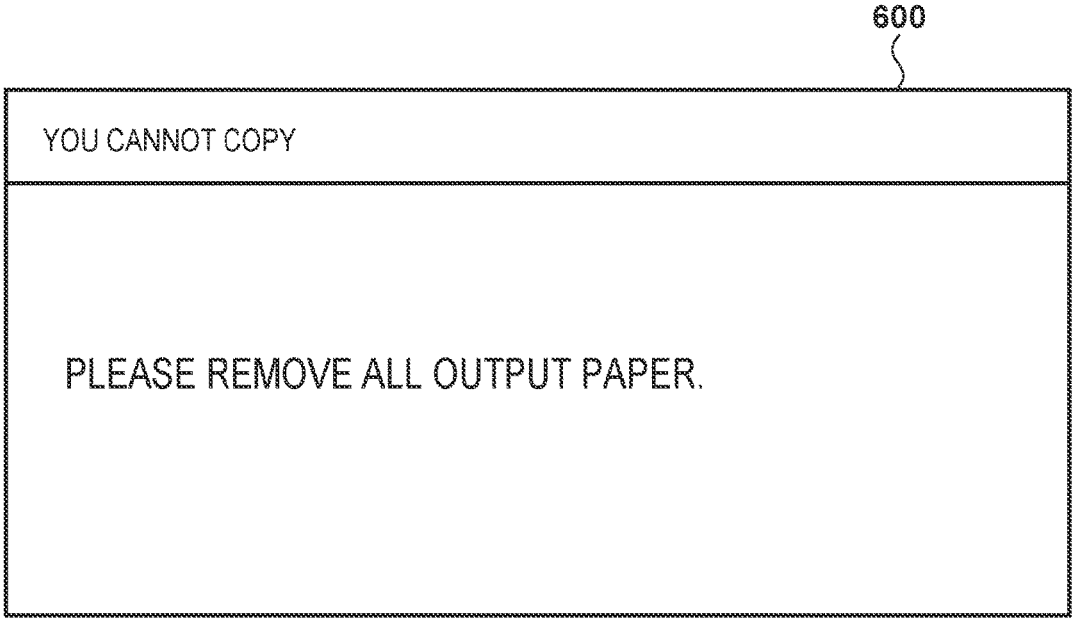
FIG. 6 is a view showing an example of a display screen of an operation panel of a copying machine shown in FIG. 1.

FIG. 6 is a view showing a display example of the warning message.

Here, the tray becomes full, urging a user to remove output bundles.

Note that if it is determined in step S109 that the count value of the number of bundles of printing media is equal to or smaller than the upper limit value of the number of stacked copies ($Y\leq X$, $Y\leq Xa$, or $Y\leq Xb$), the process returns to step S101, and operations of image formation and sheet processing are continued.

Therefore, as described above, according to this embodiment, the upper limit value of the number of bundles of printing media stacked on the tray is set according to the type of stapling processing, and the number of bundles of stacked printing media is changed in accordance with the upper limit value. This makes it possible to set the volume of printing media stacked on the tray to an appropriate volume in accordance with the type of stapling processing.

Second Embodiment

Figure 7:
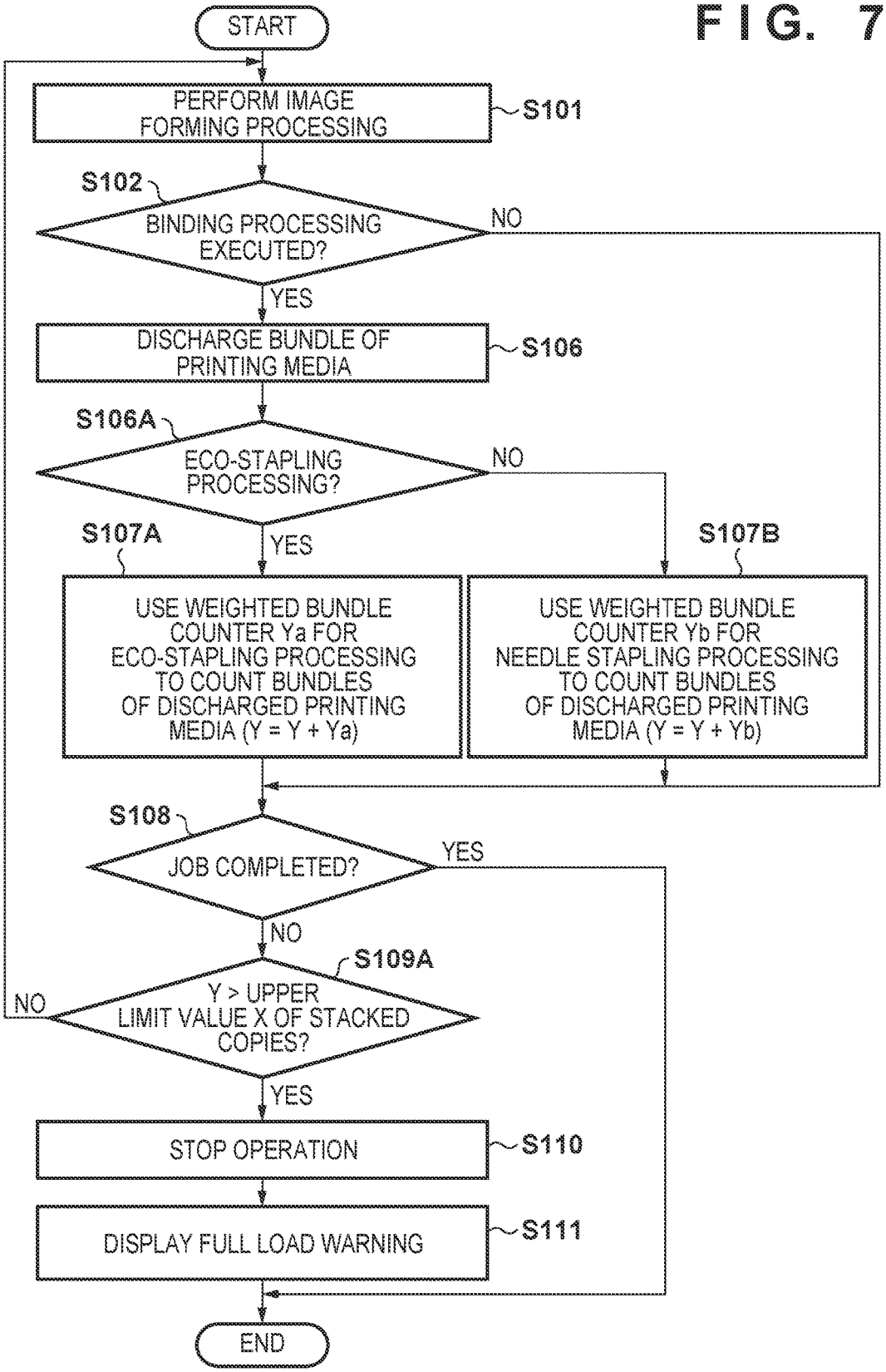
FIG. 7 is a flowchart showing binding processing according to the second embodiment.
Figure 8:
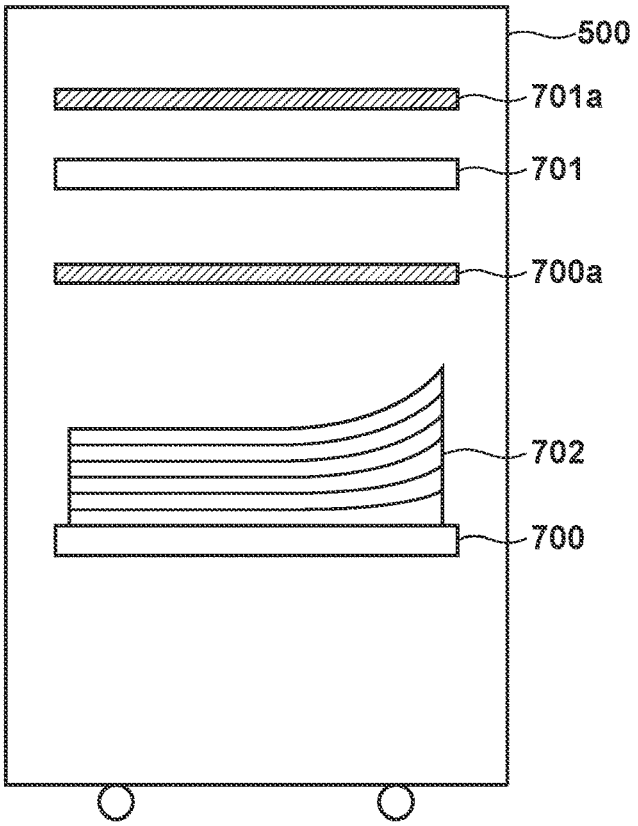
FIG. 8 is a view showing the state of printing media stacked on a conventional sheet binding processing apparatus.
Figure 9:
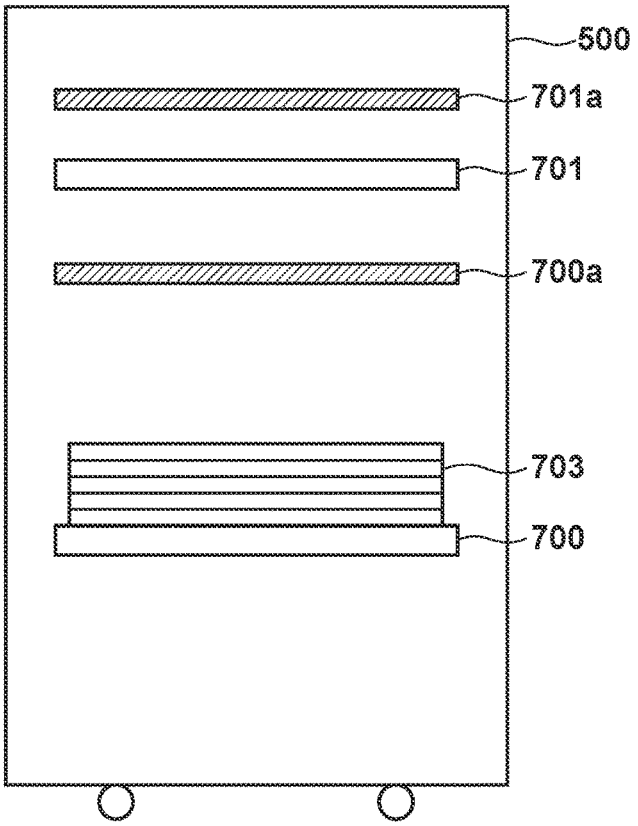
FIG. 9 is a view showing the state of printing media stacked on the conventional sheet binding processing apparatus.

FIG. 7 is a flowchart showing binding processing according to the second embodiment. In the second embodiment, a process in a case in which a bundle that has undergone eco-stapling processing, a bundle that has undergone needle stapling processing, and a bundle that has not undergone binding processing are mixed on a tray 700 will be described. Note that in FIG. 7, the same processing steps as already described in the first embodiment are denoted by the same step reference numbers, and a description thereof will be omitted. Only characteristic processing steps of the second embodiment will be described here.

If it is determined that binding processing is executed after steps S101 and S102, the process advances to step S106 directly. If it is determined that binding processing is not executed, the same process as in the first embodiment is performed. After the process in step S106, it is determined in step S106A whether the processing is needle stapling processing or eco-stapling processing as in step S103 of the first embodiment.

If it is determined here that eco-stapling processing is performed, the process advances to step S107A in which a weighted bundle counter Ya of printing media in eco-stapling processing is used to accumulate counts of bundles Y of discharged printing media. In contrast, if it is determined that needle stapling processing is performed, the process advances to step S107B in which a weighted bundle counter Yb of printing media in needle stapling processing is used to accumulate counts of the bundles Y of discharged printing media. Note that the height of each bundle of discharged printing media becomes higher in needle stapling processing than in eco-stapling processing, making weighting of the printing media in needle stapling processing larger than that in eco-stapling processing. In a case in which, for example, weighting of the printing media in eco-stapling processing is 1.1, and weighting of the printing media in needle stapling processing is 1.4, Ya=1.1×10=11, Yb=1.433 10=14, and the count value of the number Y of bundles becomes Y=25 if 10 bundles of printing media are discharged for each binding method.

After that, step S108 is executed as in the first embodiment. If it is determined that a print job is not completed, the process compares, in step S109A, the count value Y of the number of bundles of printing media discharged to the tray 700 with an upper limit value X of the number of stacked copies preset in the tray 700. The process advances to step S110 if the count value Y of the number of bundles of printing media exceeds the upper limit value X of the number of stacked copies (Y>X), and the process returns to step S101 if the count value Y of the number of bundles of printing media is equal to or smaller than the upper limit value X of the number of stacked copies (Y≤X).

Note that in the second embodiment, if it is determined in step S102 that binding processing is not executed, the printing media is counted to be used as the count value Y, and the process advances to processing step S108. In the second embodiment, the count value Y is weighted, and thus the value becomes larger than the actual number of bundles. Therefore, the upper limit value X of the number of stacked copies is also set in accordance with weighting. For example, if the upper limit of the number of stacked copies when a staple is performed on all the discharged printing media is 50, the upper limit value X of the number of stacked copies is 50×1.4=70.

Therefore, as described above, according to the second embodiment, even in the case in which the bundle that has undergone eco-stapling processing, the bundle that has undergone needle stapling processing, and the bundle that has not undergone binding processing are mixed on a discharge tray, it is possible to set the volume of the printing media stacked on the discharge tray to the appropriate volume according to the type of stapling processing.

Note that in the above-described embodiments, the binding processing mechanism is changed in accordance with whether binding processing uses the eco-stapler or the needle stapler. However, the binding processing mechanism may be changed when a needle stapler different in length of each staple used or upper limit number of binding is used. Moreover, the height of the bundle of printing media that has undergone eco-stapling processing may be about the same as in a case in which binding processing is not performed, and thus the upper limit value of the number of stacked copies in eco-stapling processing may not be set, and discharge of the printing media may be stopped if a volume that does not allow the tray 700 to move downward further is discharged.

Note that the above-described embodiments have been described assuming that a system arrangement externally attaches, to the main body of the copying machine, the sheet binding processing apparatus configured as a separate and independent housing. However, the present invention is not limited to this. For example, the present invention is also applicable to, for example, an arrangement in which the sheet binding processing apparatus is incorporated in one housing of the main body as a post processing unit or an arrangement in which the printing media are passed from the copying machine to the sheet binding processing apparatus via a relay path apparatus. Further, the present invention is also applicable to a system of an arrangement in which a plurality of sheet processing apparatuses are connected.

Therefore, according to the present invention, it is possible to set the volume of sheets stacked on a stacking unit to an appropriate volume according to the type of binding processing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A sheet binding processing apparatus comprising:

a first sheet binding unit configured to be capable of performing first binding processing that uses a staple;

a second sheet binding unit configured to be capable of performing second binding processing that does not use a staple; and a control unit configured to regulate discharge of sheets to a stacking unit in a case in which an amount of the sheets that have undergone the first binding processing performed by the first sheet binding unit and been discharged to the stacking unit reaches a predetermined first upper limit value, and in a case in which an amount of sheets that have undergone the second binding processing performed by the second sheet binding unit and been discharged to the stacking unit reaches a predetermined second upper limit value larger than the first upper limit value.

2. The sheet binding processing apparatus according to claim 1, further comprising a display unit configured to display a message indicating that bundles of the sheets are fully stacked on the stacking unit in a case where the control unit regulates discharge of the sheets.

3. The sheet binding processing apparatus according to claim 1, further comprising a count unit configured to count the amount of sheets that have undergone the first binding processing and been discharged to the stacking unit, and count the amount of sheets that have undergone the second binding processing and been discharged to the stacking unit.

4. The sheet binding processing apparatus according to claim 3, wherein the amount of sheets includes a value obtained by assigning a first weight to a number of bundles of sheets that have undergone the first binding processing, and a value obtained by assigning a second weight smaller than the first weight to a number of bundles of sheets that have undergone the second binding processing.

5. The sheet binding processing apparatus according to claim 3, wherein the amount of sheets includes a number of bundles of sheets.

6. The sheet binding processing apparatus according to claim 1, wherein the predetermined second upper limit value is set to be smaller than a stackable amount of sheets that have not been subjected to the first sheet binding processing and the second sheet binding processing on the stacking unit.

* * * * *